US007175039B2

(12) United States Patent
German et al.

(10) Patent No.: US 7,175,039 B2
(45) Date of Patent: Feb. 13, 2007

(54) COMPOSITE CLOSURE

(75) Inventors: Galen German, Lancaster, OH (US); James L. Martin, Lancaster, OH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 4 days.

(21) Appl. No.: 10/721,029

(22) Filed: Nov. 24, 2003

(65) Prior Publication Data

US 2004/0149676 A1 Aug. 5, 2004

Related U.S. Application Data

(63) Continuation-in-part of application No. 10/062,115, filed on Jan. 31, 2002, now Pat. No. 6,662,958.

(51) Int. Cl.
*B65D 41/34* (2006.01)

(52) U.S. Cl. ..... 215/252; 215/252; 215/350; 215/274

(58) Field of Classification Search ..... 215/252, 215/274, 276, 350
See application file for complete search history.

(56) References Cited

U.S. PATENT DOCUMENTS 3,913,771 A * 10/1975 Acton et al. ..... 215/256
3,913,772 A * 10/1975 Ochs ..... 215/256
3,930,589 A * 1/1976 Koontz ..... 215/352
4,066,181 A * 1/1978 Robinson et al. ..... 215/256
4,093,094 A * 6/1978 Smalley et al. ..... 215/276
4,121,729 A * 10/1978 Husum ..... 215/276
4,408,694 A * 10/1983 Mueller ..... 215/276
4,473,163 A * 9/1984 Geiger ..... 215/250
4,679,696 A 7/1987 Bonnenfant et al. ..... 215/252
4,694,969 A * 9/1987 Granat ..... 215/252
4,694,970 A * 9/1987 Hayes ..... 215/252
4,705,183 A * 11/1987 Moloney ..... 215/276
4,721,219 A * 1/1988 Dullabaun et al. ..... 215/274
4,782,968 A * 11/1988 Hayes ..... 215/276
4,801,029 A * 1/1989 Begley ..... 215/250
4,809,858 A 3/1989 Ochs ..... 215/276
4,813,561 A * 3/1989 Ochs ..... 215/252
4,852,753 A * 8/1989 Ochs ..... 215/271
4,880,127 A 11/1989 Doi ..... 215/252
4,981,230 A * 1/1991 Marshall et al. ..... 215/252
4,989,740 A * 2/1991 Vercillo ..... 215/252
4,993,572 A * 2/1991 Ochs ..... 215/260
5,009,324 A 4/1991 Ochs ..... 215/276

(Continued)

*Primary Examiner*—Nathan J. Newhouse
*Assistant Examiner*—James Smalley
(74) *Attorney, Agent, or Firm*—Woodcock Washburn LLP

(57) ABSTRACT

A composite closure includes a band and an insert disk. A contact surface urges downwardly against the disk even while the band moves longitudinally relative to the disk or container. The closure has a fully tightened position in which the band's ring contacts the disk's annular channel, a loose position in which the ring is spaced apart from the annular channel, and an intermediate tightened position in which the ring is spaced apart from the disk and the contact surface urges against the curl. Another composite closure includes plural fins or gussets. The fins or gussets engage the peripheral curl of the insert disk to secure the band to the disk, which provides a resistance to initial unscrewing of the band. The disengagement torque required to disengage the curl from the fins may enable the closure to function as a one-piece closure.

13 Claims, 4 Drawing Sheets

U.S. PATENT DOCUMENTS

| | | | | | |
|---|---|---|---|---|---|
| 5,027,964 | A | * | 7/1991 | Banich, Sr. | 215/252 |
| 5,031,787 | A | | 7/1991 | Ochs | 215/276 |
| 5,062,538 | A | * | 11/1991 | Ochs | 215/260 |
| 5,078,290 | A | * | 1/1992 | Ochs | 215/276 |
| 5,258,191 | A | * | 11/1993 | Hayes | 426/107 |
| 5,341,949 | A | * | 8/1994 | Hayes | 215/253 |
| 5,346,082 | A | * | 9/1994 | Ochs et al. | 215/252 |
| 5,443,853 | A | * | 8/1995 | Hayes | 426/107 |
| 5,660,290 | A | | 8/1997 | Hayes | 215/252 |
| 5,685,443 | A | | 11/1997 | Taber et al. | 215/252 |
| 5,809,860 | A | | 9/1998 | Haaser | 83/880 |
| 5,839,592 | A | * | 11/1998 | Hayes | 215/230 |
| 6,056,136 | A | * | 5/2000 | Taber et al. | 215/252 |
| 6,220,466 | B1 | | 4/2001 | Hayes et al. | 215/276 |
| 6,276,543 | B1 | | 8/2001 | German et al. | 215/252 |
| 6,502,710 | B1 | * | 1/2003 | Bosl et al. | 215/351 |
| 6,662,958 | B2 | | 12/2003 | German et al. | 215/252 |
| 6,722,513 | B1 | * | 4/2004 | Flood et al. | 215/11.1 |
| 2003/0127419 | A1 | * | 7/2003 | Shenkar et al. | 215/256 |

* cited by examiner

COMPOSITE CLOSURE

FIELD OF THE INVENTION

This application is a continuation-in-part of prior application Ser. No. 10/062,115, which was filed on Jan. 31, 2002 now U.S. Pat. No. 6,662,958 and is incorporated herein by reference in its entirety.

BACKGROUND OF THE INVENTION

Composite closures typically include a metal insert disk and a plastic band. The disk often includes a channel for receiving a rim of the container and the band often includes a threaded skirt and a ring that extends inwardly from a top portion of the skirt. A sealant may be disposed between the container rim and the channel to enhance the seal therebetween. U.S. Pat. No. 5,685,443, entitled "Composite Closure And Method Of Making Same;" U.S. Pat. No. 6,220,466, entitled "Composite Closure, Method For Assembling It And Method For Closing A Container With It;" and U.S. Pat. No. 5,031,787, entitled "Low Height Floating Disk Closure," each of which is incorporated herein by reference in its entirety, generally disclose examples of composite closures.

Often, composite closures include a floating disk such that the band is capable of longitudinal movement relative to the insert disk. A tamper evident band may depend from the bottom of the skirt, and a bead may be disposed on an interior of the skirt to urge against a periphery of the disk to separate the insert disk from the container rim during the opening process. Floating disk closures are often configured for sequential opening such that, during the initial opening process, the tamper evident band fractures before the bead urges upwardly against a periphery of the disk to break the vacuum seal.

There is a general goal in the packaging industry for improved composite closures.

SUMMARY OF THE INVENTION

A closure and container package is provided in which the container has a neck with container threads formed thereon. The closure includes a circular disk and a band. The disk includes a curl formed at a periphery thereof and forms a seal with the container neck.

The band includes an annular skirt including closure threads formed on an interior surface thereof and plural fins extending inwardly from the skirt. The fins have a first, as-molded state prior to application of the closure onto the container and a second, fully applied state in which the fins deformably receive at least a portion of the curl upon application of the closure onto the container. In this regard, the fins engage the curl to secure the band to the disk. The fins may be gussets.

The closure threads engage the container threads in the closure's fully applied state upon initial application of the closure onto the container, but the thread-to-thread interaction between the bottle and the closure may diminish upon subsequent thermal processing of the package (such as pasteurization, retorting, and the like). Engagement between the fins and the curl provides a sensible resistance upon initial rotation or unscrewing of the closure from its fully applied state, which may provide a sensible resistance to a user unscrewing the container.

The disengagement torque for disengaging the fins from the curl may be less than an unsealing torque for breaking the seal between the disk and the container neck, such that upon initial rotation of the closure from its fully applied state the band disengages from the disk. Such disengagement torque provides a sensible resistance upon initial rotation of the closure from its fully applied state.

Alternatively, the disengagement torque may be greater than an unsealing torque for breaking the seal between the disk and the container neck, such that upon initial unscrewing of the closure the band and disk are unscrewed substantially together. Such disengagement torque may also provide a sensible resistance upon initial rotation of the closure from its fully applied state.

A composite closure for coupling with a container is provided that includes an insert disk and a band. The insert disk includes a curl formed at a periphery thereof. The band includes an annular skirt, a retaining feature, a ring, and a contact surface. The skirt includes threads formed on an interior surface thereof. The retaining feature extends radially inwardly from the skirt. The ring extends radially inwardly from an upper portion of the skirt over the disk. The contact surface extends inwardly from the skirt such that the contact surface and the retaining feature form a recess therebetween for receiving the disk curl. The contact surface urges downwardly against the disk curl while the closure is screwed onto its corresponding container.

Preferably, the closure has a fully tightened position in which the ring contacts the disk, a loose position in which the ring is spaced apart from the disk, and an intermediate tightened position in which the ring is spaced apart from the disk and in which the contact surface urges against the curl. The intermediate tightened position is between the fully tightened position and the loose position. Preferably, the contact surface of the band exerts positive sealing force downwardly onto the disk upon initial opening of the closure—even while the ring is spaced apart from or stops urging against the disk during the initial stage of the opening process. Exerting such downward force on the disk inhibits tampering with the container package during the initial stage of the opening process before a frangible tamper evident band fractures (or suitable other type of tamper evident band indicates opening). A closure and container combination is also disclosed.

DETAILED DESCRIPTION OF ILLUSTRATIVE EMBODIMENTS

Figure 1:
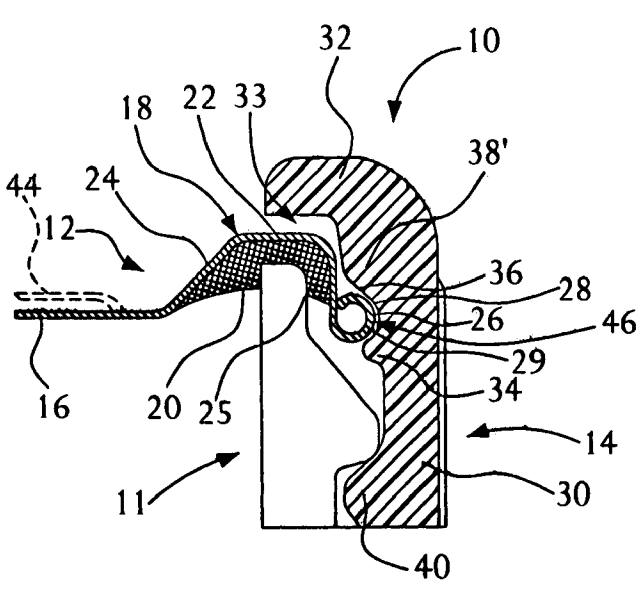
FIG. 1 is a partial longitudinal cross sectional view of a closure and container assembly in a loose position.

As shown in FIG. 1, a closure and container combination includes a composite closure 10 and a corresponding container 1. Closure 10 includes an insert disk 12 and circumferential band 14. Preferably, insert disk 12 is formed of a metal and band 14 is formed of a plastic, as will be understood by persons familiar with composite closure technology, and the present invention encompasses any suitable materials.

Disk 12 includes a center portion 16 and an annular channel 18 disposed circumferentially about center portion 16. A tamper indicating button 44 is shown in dashed lines in FIGS. 1 and 7 to indicate that it is optional. Channel 18, which is substantially downward-facing, is formed by an inboard wall 24 and an outboard wall 25 with a top surface 22 formed therebetween. Preferably, channel top surface 22 forms a substantially flat top surface. A sealant 20, such as plastisol or other conventional material, may be disposed in the channel. Channel inboard wall 24 is shown having a sloped profile, in cross section, and channel outboard wall 25 is shown having a substantially vertical profile, although the present invention encompasses disks having any configurations.

A curl 26 is formed at the lower end of channel outboard wall 25, and preferably extends radially outwardly. As shown in the figures, curl 26 includes an upper surface 28 and a lower surface 29. Preferably, the cut edge is curved generally radially outwardly at the bottom portion of channel outer wall 25 and then curves radially inwardly such that the cut edge is not exposed and such that curl 26 is circular or rounded in longitudinal cross section. Thus, upper and lower surfaces 28 and 29 are defined, in longitudinal cross section and as shown in the figures, by approximately ninety degrees of a circle above and below, respectively, a horizontal line (not identified in the figures). The present invention is not limited to the configuration of curl 26, upper surface 28, and lower surface 29 shown in the figures, but rather encompasses any configuration that provides a surface against which retaining bead 34 or like structure may act, as explained more fully below.

Band 14 includes an annular skirt 30 and a ring 32 extending radially inwardly from an upper portion of skirt 30. Threads 40 extend radially inwardly from an interior portion of skirt 30. Depending on the position of band 14 relative to container 11 and disk 12, the underside of ring 32 and disk top surface 22 may be spaced apart to form a gap 33. Above threads 40, a retaining feature, such as bead 34, extends substantially radially inwardly from skirt 30. Alternatively, retaining bead 34 may be omitted and the closure may be configured such that a top portion 40' of the closure threads may perform the function of the retaining bead, as shown schematically in dashed lines in FIG. 8. In this regard, the term "retaining feature" encompasses retaining bead 34, closure thread top portion 40', and any other structure that performs the retaining function and/or opening function. Above retaining bead 34 (or alternatively, thread top portion 40'), a contact structure, which is generally referred to herein by reference numeral 38 (which encompasses reference numerals 38' and 38", as described below), extends radially inwardly from skirt 30, and preferably is integrally coupled to ring 32.

Figure 6:
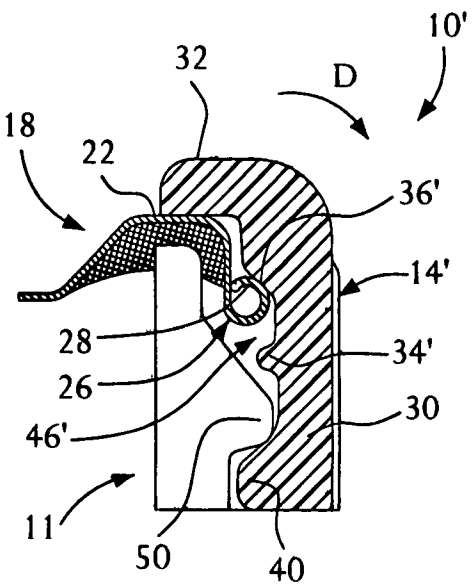
FIG. 6 is a partial longitudinal cross sectional view of the closure and container shown in FIG. 4 in a fully tightened position.
Figure 7:
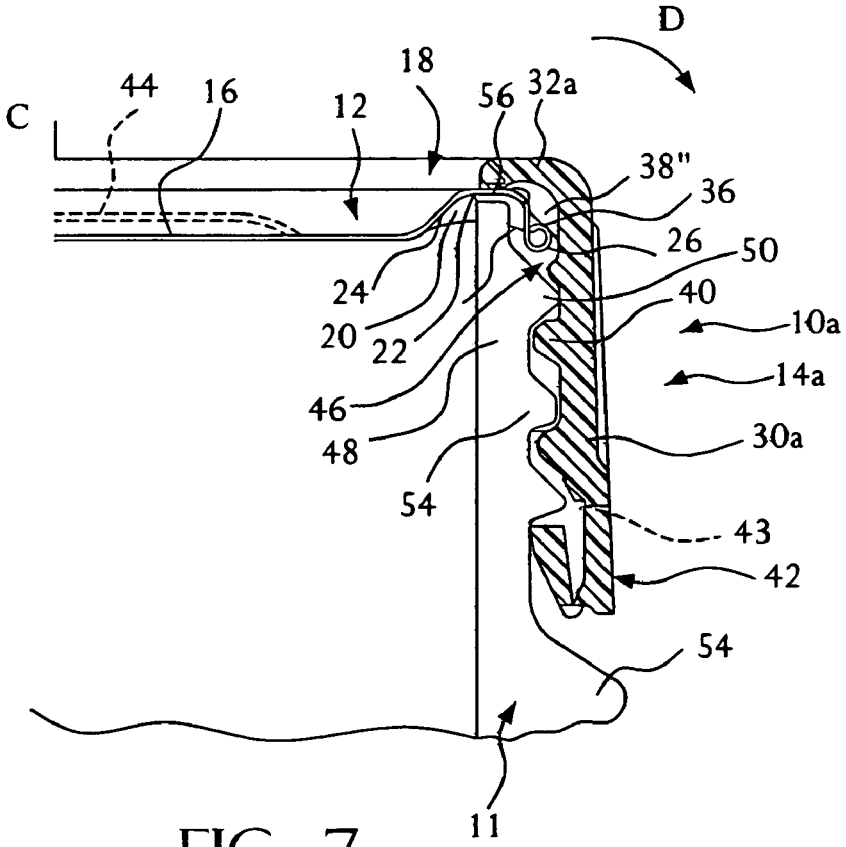
FIG. 7 is an enlarged partial longitudinal cross sectional view illustrating additional features encompassed by the present invention.

Contact structure 38 may be a formed by a circumferentially continuous bead, which is referred to herein by reference numeral 38' and is shown in longitudinal cross section in FIGS. 1 through 6, a circumferentially discontinuous bead that is formed by arcuate segments, or circumferentially distributed gussets, which will be referred to herein by reference numeral 38" and are shown in FIGS. 7 though 9. Reference numeral 38 refers to any structure, including but not limited any of the structures described herein, that form a contact surface 36 which includes a surface that is angled or oblique relative to a longitudinal centerline C, which is best shown in FIG. 8, in longitudinal cross section.

Figure 8:
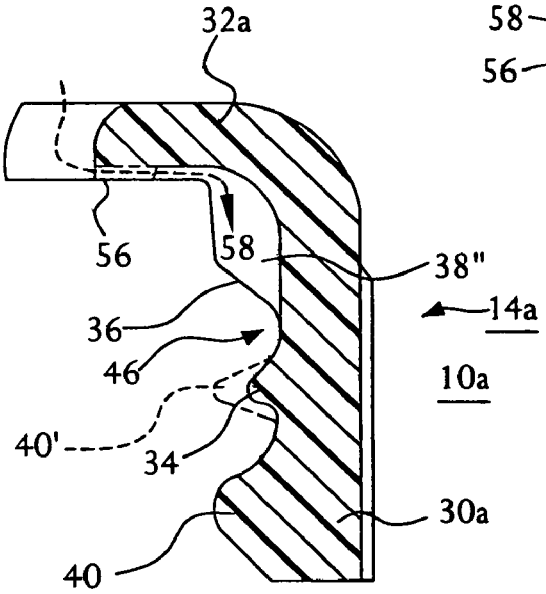
FIG. 8 is an enlarge cross sectional view of a portion of the closure shown in FIG. 7.
Figure 9:
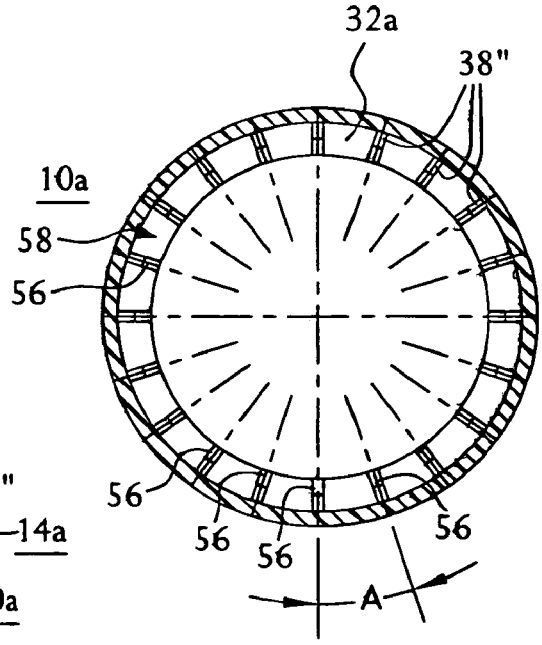
FIG. 9 is a transverse cross sectional view of an embodiment of the present invention.

FIGS. 7 and 8 show a longitudinal cross sectional view of a closure, which is indicated by reference numeral 10*a*, that is formed with gussets 38". Closure 10*a* includes a band 14*a*, a skirt 30*a*, and a ring 32*a*. As best shown in FIG. 9, from which portions of closure 10*a* have been removed for clarity, gussets 38" preferably are equidistantly spaced around an upper portion of the interior of skirt 30*a* and are oriented radially. Pads 56 depend downwardly from the underside of ring 32*a*. Pads 56 preferably are continuous with gussets 38" such that passages 58 are formed between adjacent pads 56 and gussets 38", thereby enabling communication between ring 32 and disk 12. Passages 58 thus may expose the area around the area of the curl 26 and gap 46 even while the closure 10*a* is in its fully tightened position. Like passages may be formed by discontinuities in bead 38' (not shown).

As shown in the Figures, bead 38' and gusset 38" preferably are integrally formed with skirt 30 or 30*a* and ring 32 or 32*a*. Thus, an upper portion of bead 38' or gusset 38" merges into the underside of ring 32 or 32*a*, and a radially outboard portion of bead 38' or gusset 38" merges into skirt 30 or 30*a*. Bead 38' or gusset 38" thereby stiffen ring 32 or 32*a* relative to skirt 30, and may diminish the magnitude of deflection of the closure upon tightening, as described more fully below. In this regard, bead 38' and gussets 38" form stiffeners. Contact surface 36, as shown in the Figures, is preferably adjacent to skirt 30 and is spaced apart from ring 32 by a substantially vertical section (in longitudinal cross section), although the present invention encompasses any cross sectional configuration of bead 38' and gussets 38".

Figure 3:
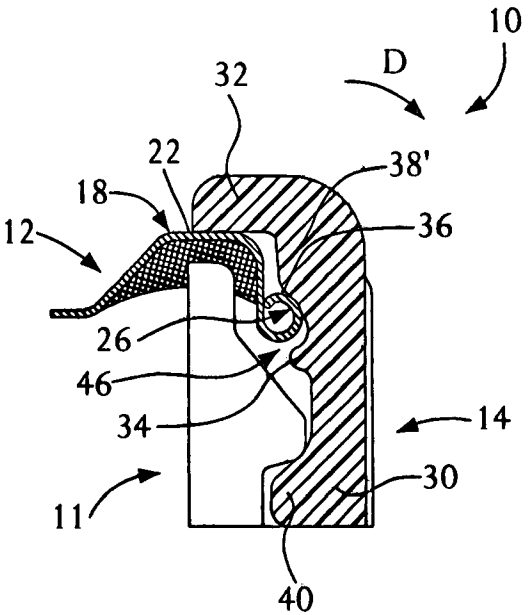
FIG. 3 is a partial longitudinal cross sectional view of the closure and container shown in FIG. 1 in a fully tightened position.
Figure 2:
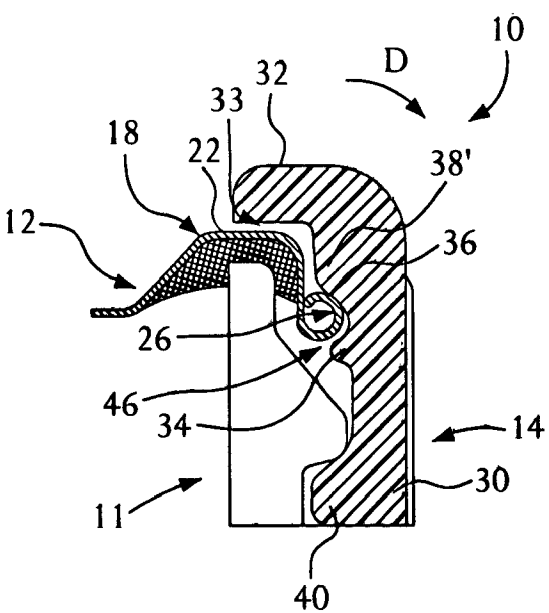
FIG. 2 is a partial longitudinal cross sectional view of the closure and container shown in FIG. 1 in an intermediate position.

Contact surface 36 is longitudinally spaced apart from retaining bead 34 (or thread top portion 40') so as to form a gap 46 therebetween. As shown in FIGS. 1 through 3, illustrating an embodiment of the closure according to an aspect of the present invention, retaining bead 34 and contact surface 36 are spaced apart such that curl 26 is moveable between bead 34 and surface 36 only by a small amount, thereby enabling sequential opening. Alternatively, bead 34 and contact surface 36 may be spaced apart by a dimension such that bead 34 and contact surface 36 are in simultaneous contact with curl 26. Thus, contact surface 36 would contact curl upper surface 28 while bead 34 contacts curl lower surface 29. The present description employs the embodiment that includes retaining bead 34 to illustrate gap 46. The present invention, however, is not limited to such an embodiment, but rather includes any structure that is capable of retaining disk 12, including the embodiment employing thread top portion 40' for contacting curl lower surface 29. In this regard, FIG. 8 schematically shows thread top portion 40' in phantom to indicate that thread top portion 40', rather than (or in combination with a bead) may contact curl 26.

Figure 5:
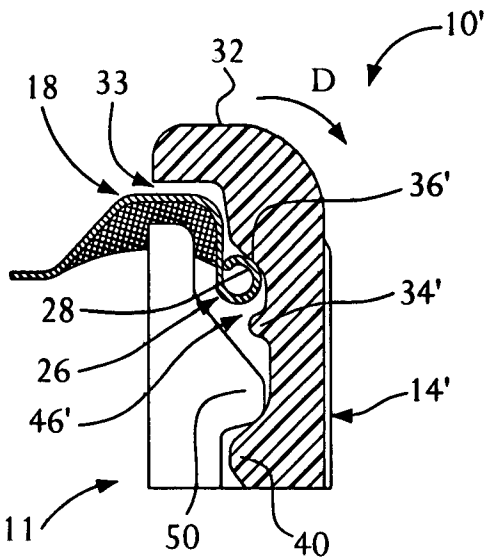
FIG. 5 is a partial longitudinal cross sectional view of the closure and container shown in FIG. 4 in an intermediate position.
Figure 4:
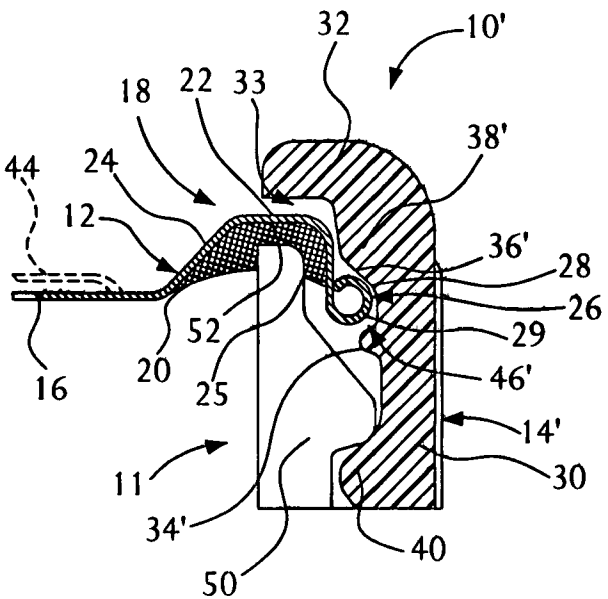
FIG. 4 is a partial longitudinal cross sectional view illustrating another embodiment of a closure and container assembly.

As shown in FIGS. 4 through 6, illustrating another embodiment of an aspect of the present invention, a closure 10' includes a metal disk 12, which is identical to the disk described above with respect to the first embodiment, and a band 14'. Band 14' includes all of the components of band 14 as described above, but a retaining bead 34' is spaced apart from a contact surface 36' to form a gap 46' therebetween. Alternatively, gap 46' may be formed by closure thread top portion 40' (not shown in FIGS. 4 through 6), as described above. Gap 46' has a longitudinal dimension that enables curl 26 to float between band 14' and contact surface 36', as described more fully below. FIGS. 4 through 6 employ a bead 38' to illustrate the gap 46', although gap 46' may be employed with gussets 38", as will be clear to persons familiar with closure technology in view of the present disclosure.

Container 11, with which closure 10, 10', and/or 10' may be coupled, includes a neck 48 having threads 50 and forming a rim 52. As in conventional closures and containers, rim 52 protrudes into channel 18 such that sealant 20 is deformed to enhance a seal between disk 12 and container 11. As shown in FIG. 7, a tamper evident bead or lug 54 may protrude outwardly from neck 48 below threads 50 to cooperate with a tamper evident band 42 that is coupled at frangible connection 43 to a lower portion of skirt 30. FIG. 7 illustrates tamper evident band 42 and schematically shows connection 43. As is common in many container and closure packages, connection 43 fractures in response to initial rotation of the closure to indicate that the seal on the package has been broken.

Contact surface 36 or 36' is angled downwardly to urge downwardly onto curl 26 even while maintaining the capability of disk 12 to float or slide relative to band 14 or 14'. Thus, contact surface 36 or 36' may form a right circular cone or any other shape that forms a surface on which curl 26 is capable of riding, and encompasses surfaces having a stepped cross sectional profile that changes slope (not shown). The present invention encompasses a contact surface (not shown) that is substantially horizontal (that is, perpendicular to longitudinal axis C), and/or encompasses a peripheral portion of a disk (not shown) having a non-curled periphery, which may be oblique to longitudinal axis C and/or may be flexible.

The following description of loose, intermediate, and tightened positions employs the configuration that employs continuous bead 38, and omits particular reference to the configuration that employs gussets 38" for convenience and brevity. The following description is, of course, equally applicable to configurations employing gussets 38" (that is, to closure 10*a*). FIGS. 1 and 4 illustrate band 14 and 14', respectively, in a loose position (or a plurality of positions) such that band 14 or 14' is threaded onto container 11 at a position in which band 14 or 14' does not exert any upward or downward force on disk 12. The loose position shown in FIGS. 1 and 4 may be encountered, for example, during the initial capping process after disk 12 has been installed onto container 11, or during the initial opening process (that is, the first time the factory seal between container 11 and disk 12 is to be broken) or subsequent opening processes.

FIGS. 2 and 5 illustrate an intermediate position of closure 10 and 10', respectively, which is obtained by screwing or tightening closure 10 or 10' onto container 11 from the loose position shown in FIGS. 1 and 4. In the loose position, the underside of ring 32 is spaced apart from the top surface 22 to form gap 33 therebetween. Gap 33 preferably exists in the intermediate position with a smaller magnitude than that in the loose position. In the intermediate position, even though ring 32 is spaced apart from the top surface 22 of disk 12, band 14 or 14' urges disk 12 downwardly against container rim 52 because contact surface 36 or 36' urges downwardly on curl 26. Upon further tightening of closure 10 or 10', curl 26 may slide relatively upwards on contact surface 36 or 36' until ring 32 contacts disk top surface 22. Upon subsequent tightening past the intermediate position, a closure 10 or 10' eventually reaches a fully tightened position, which is shown in FIGS. 3 and 6. In the fully tightened position, preferably both the ring 32 and contact surface 36 or 36' urge downwardly on disk 12, that is, via disk top surface 22 and curl upper surface 28, respectively.

The term "intermediate position" is employed herein to indicate the position of curl 26 relative to contact surface 36 or 36', and encompasses any position between the loose position and the fully tightened position. Similarly, the term "fully tightened position" is employed herein to indicate an intended or predetermined position, although ring 32 may contact disk top surface 22 prior to the closure achieving the fully tightened position and the closure may be tightened beyond the position at which ring 32 contacts disk top surface 22. Further, the present invention encompasses any configuration of bands, including those, for example, that lack a ring. In the figures, contact surface 36 or 36' maintains contact with curl 26 between the intermediate and fully tightened positions, but the present invention is not limited to such structure. Rather, the present invention encompasses any structure that releases its downward force component during any stage of the tightening and/or loosening process.

During the initial opening process, a user may unscrew closure 10 or 10' relative to container 11 to urge ring 32 upward relative to rim 52. In the opening process, even while ring 32 stops providing an effective downward force on disk 12, contact surface 36 or 36' urges downwardly against curl upper surface 28, thereby promoting contact of disk 12 with container 11. For closures that include tamper evident bands 42, contact surface 36 or 36' may maintain contact with curl upper surface 28 until tamper evident band connection 43 is fractured, thereby enhancing tamper indicating features of the package. Preferably, closures 10 and 10' undergo sequential opening such that after connection 43 is fractured, retaining bead 34 (or thread top portion 40') urges against curl 26 to lift disk 12 from container neck 48.

Ring 32 may have a tendency to expand radially outwardly in response to tightening of band 14 or 14' as contact surface 36 or 36' urges against curl upper surface 28 with a force that has both longitudinal and radial components. Radial outward expansion of ring 32 is indicated by the directional arrow D, which is shown as curved to indicate that band 14 or 14' pivots outwardly as it is drawn down relative to container 11. Stiffeners 38' and/or 38" stiffen ring 32 and/or 32*a* and may inhibit gap formation between the inboard edge of ring 32 and/or 32*a* and channel top surface 22. The present invention is not limited to closures employing such stiffeners, but rather encompasses closures that lack any stiffening means.

Typically, because curl 26 is relatively inelastic compared to band 14 or 14', curl 26 will deflect or deform much less than band 14 or 14'. The present invention is not limited to such a configuration, but rather encompasses composite closures (not shown in the Figures) in which the peripheral edge or curl of the closure deflects more than that shown in the figures. In such a configuration, the contact surface on the skirt may be reconfigured to cooperate with such closure edge deflection. In this regard, the present invention encompasses that the peripheral edge or curl may not slide on the closure skirt.

Securing the contents within a container and providing indication of tampering have been a goal of composite closure design. For some prior art closures, it may be possible to partially unscrew a conventional band to provide sufficient space between the conventional closure ring and the insert disk (that is, the space that corresponds to gap 33 in the present closure) to enable rupture of the seal between the disk and the container, yet such unscrewing may be not be enough to fracture the TE band connection. For example, a person seeking to tamper with the contents within a container may, especially in the presence of elevated temperature to soften the plastic of a prior art closure and/or container, unscrew the closure enough such that the tamper evident band does not fracture, but such that the ring is spaced apart from the disk. Thus, the disk may be separated from the container, by (for example) squeezing the container, to enable tampering, even though the tamper evident band does not indicate that the closure had been opened. Separating the disk in this manner may be especially feasible for plastic hot fill or retort containers, which generally have a lower internal negative pressure, although the lack of certainty in the tamper evidence is problematic for all closures, including closures that lack a tamper indicating button 44, which is a common configuration for hot-fill applications employing a container formed of plastic, as well as other applications.

The possibility for a person to defeat a prior art tamper evident system, as described above, may in principle be overcome by configuring a closure such that the tamper evident band fits snugly against the tamper evident bead or lug on the container neck, thereby causing the tamper evident band to fracture upon initial backing off of the closure from its fully tightened position. It is difficult for a closure (having any particular closure dimensions), however, to fit snugly against all tamper evident beads or lugs in all circumstances. For example, variations among filling facilities, capping machinery vendors, machinery torque and/or number of turn settings, and like parameters make it difficult or impractical in a high-speed, industrial context to repeatably and accurately install the closure in a position that always prohibits the above-described possibility of tampering.

This problem of the prior art is provided to illustrate a drawback that is substantially overcome by aspects of the present invention. As will be clear to persons familiar with prior art closures in light of the present disclosure, the present invention is applicable in circumstances in which the problems described herein are not present. Thus, the present invention is not limited to solving the particular prior art problems or drawbacks described herein, but rather encompasses any closure that exhibits the structure or characteristics, and any variations or equivalents thereof, in general accordance with the present disclosure.

The figures illustrate particular embodiments of the present invention, and the invention is not limited to the particular embodiments shown and described herein. For example, it is obvious that gussets 38" may be employed with a gap 46' that enables longitudinal translation or floating between gussets 38" and retaining bead 34'. Further, the present invention is not limited by particular dimensions, materials, and shapes or orientations of components (including contact surfaces), but rather broadly encompasses any such parameters with respect to the claims, as will be understood by persons familiar with closure technology in view of the present disclosure.

Figure 11:
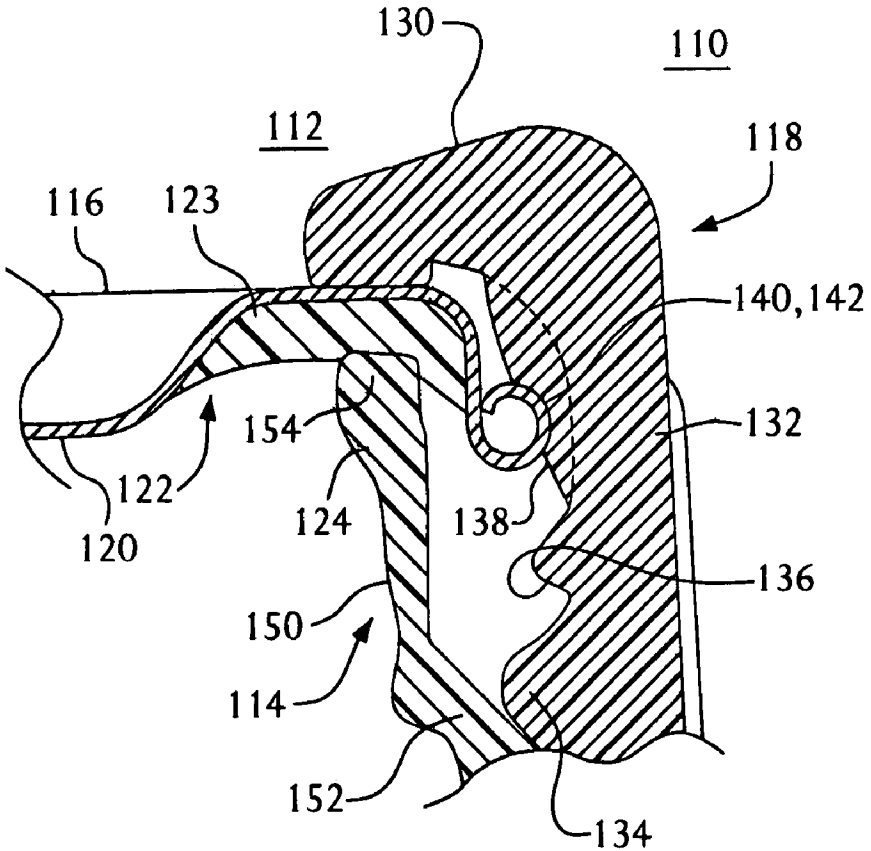
FIG. 11 is a cross sectional view of a portion of the embodiment shown in FIG. 10 including additional structure.

A closure and container package 110, which illustrates other aspects of an inventive closure, includes a closure 112 and a container 114. Container 114 includes a neck 150, threads 152 formed on an outer face of neck 150, and a rim 154, each of which are schematically shown in FIG. 11.

Container 114 may be of any conventional type, such as one suitable for receiving product contents in a hot-filling operation or suitable for a retort process. Container 114 may be formed of any material suitable for its intended use, such as glass or an appropriate plastic, as will be understood by persons familiar with container technology according to the particular requirements and uses of the container.

Closure 112 includes an insert disk 116 and a peripheral band 118. Disk 116, which preferably is circular, includes a center portion 120, a downwardly facing, annular channel 122, and a peripheral curl 124. Center portion 120 may include a button (not shown in the figures) having a downward position indicating a negative (that is, less than atmospheric) pressure within the container and, therefore, indicating that a seal between disk 116 and container rim 154 is intact.

A sealant 123, such as plastisol, is disposed in channel 122. Disk 116 may be formed of a conventional metal, such as tinplate, stainless steel, aluminum, and the like, or a plastic, as will be understood by persons familiar with conventional composite closures.

Figure 10:
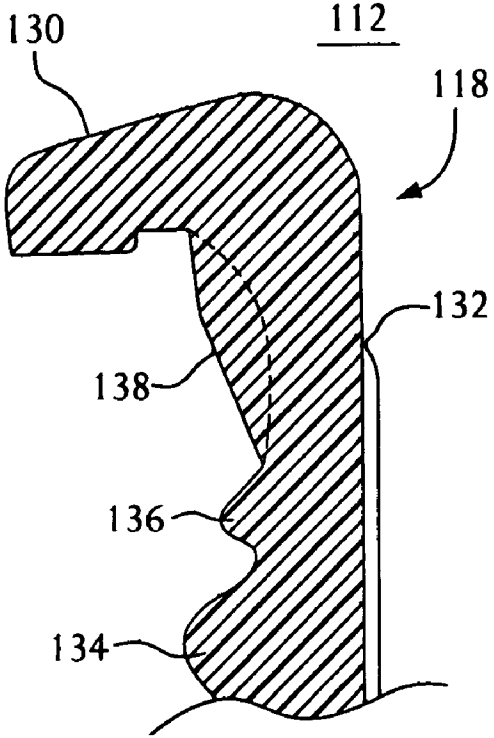
FIG. 10 is a cross sectional view of a portion of an embodiment of a closure illustrating another aspect of the present invention.

Band 118, which is shown disembodied from container 114 and disk 116 in FIG. 10, includes an inwardly extending ring 130 and a downwardly depending skirt 132. The present invention is not limited to closure 112 having ring 130, but rather encompasses closures having features disposed on the skirt that contact and interact with portions of disk 116 without a band that extends over channel 122. Band 118 may also include a tamper-evident band (not shown in the Figures) frangibly connected to a lower portion of skirt 132.

Band 118 includes threads 134 and, above threads 134, plural, circumferentially spaced fins, such as gussets 138 on the inner surface of band 118. The inner surface of band 118 may also include a retaining feature for limiting movement of disk 116 and/or for urging upwardly against curl 124 during the opening process. The retaining feature encompasses an upper surface of threads 134, a retaining bead 136 as shown in FIGS. 10 and 11, or other structure.

Gussets 138 preferably are uniformly disposed around an inner circumference of band 118. The quantity, configuration, and dimensions of fins or gussets 138 will depend upon several parameters, such as band diameter, particular material characteristics (such as hardness, modulus of elasticity, yield point, and the like), curl configuration, and the like, as will be understood by persons familiar with composite closure technology in view of the present disclosure.

Preferably, for a 40 mm closure twenty, equally spaced-apart gussets 138 are employed. Each of such gussets 138 have a width (that is, a circumferential or tangential dimension) of between 0.015 to 0.040 inches, and preferably about 0.032 inches. Closure 112 preferably is formed of a commercial grade polypropylene able to withstand the temperatures encountered during the thermal processing. Any gusset height is acceptable, depending on the particular parameters of the design, such as the insert and curl configuration. The above dimensions and information are provided for exemplary purposes only and not intended to limit the scope of the claims. Rather, the number, shape, and dimensions of the gussets will vary according to the parameters of the particular application (such as, for example, closure diameter, insert disk configuration, application temperature, closure material, and the like).

As best shown in FIG. 11, a contact surface (that is, an inwardly facing edge) 140 of the fins or gussets 138 deforms to receive at least a portion of curl 124. A recess 142 is formed in gusset 138 by the impression of curl 124 such that curl 124 becomes embedded in gusset 138. Preferably, curl 124 becomes embedded in gusset 138 upon initial application of closure 112 onto container 114 after filling. Typically, closure 112 is preheated to approximately 120° F. to 160° F., and preferably about 150° F. to enable the tamper evident band to enhance application of the cap and to soften the sealant. The preheating may also make gusset 138 more readily receive curl 124.

Preferably, each gusset 138 deforms plastically to form a recess 144. Gusset 138 may also undergo elastic deformation, which results in gusset 138 urging inwardly against curl 124. The outer portion of channel 122 may also be urging outwardly against gusset 138 in response to elastic, substantially radially inward displacement of curl 124 upon initial capping. The oblique orientation of contact surface 140 may enhance such elastic deformation of channel 122, as generally disclosed herein. The elastic deformation of gusset 138 and/or the outer portion of channel 122 may enhance securing of disk 116 to band 118.

Some conventional closures are opened sequentially such that an initial opening torque is required to initially disengage the closure threads from the container threads. After the initial opening torque is applied, additional torques may be required to break the frangible connections of the tamer-evident band and to urge the disk upwardly until the seal between the disk and the container is broken.

In package 110 in its fully applied state (prior to an initial opening of the closure such that the original seal between disk 116 and container 114 is intact), as for example shown in FIG. 11, curl 124 urges against, and preferably is embedded in, gussets 138. This engagement of curl 124 with gussets 138 secures disk 116 to band 118. The torque required to disengage gussets 138 from curl 124 is referred to herein as "disengagement torque."

Engagement between curl 124 and gussets 138 may yield a disengagement torque having a value less than the torque required to lift disk 116 until the seal between disk 116 and container 114 is broken. In such circumstances, curl 124 becomes disengaged from gussets 138 during the process of breaking the container seal, after which disk 116 may be loose between gussets 138 and retaining bead 136. Typically, breaking the container seal occurs when the retaining feature, such as retaining bead 136, is urged upwardly against curl 124 as band 118 is unscrewed.

Alternatively, engagement between curl 124 and gussets 138 may yield a disengagement torque having a value greater than the torque required to break the seal between disk 116 and container 114. In such circumstances, curl 124 remains engaged with or embedded in gussets 138 throughout the process of breaking the seal between disk 116 and container 114. Accordingly, closure 112, having a disengagement torque of sufficient value, may operate as a one-piece closure.

Securing band 118 to disk 116, regardless of the magnitude of the disengagement torque (that is, whether or not the gussets 138 disengage from curl 124 during any part of the opening process), provides a resistance to initial unscrewing of band 118 from its fully applied state. Such resistance may have many advantages, such as providing an end-user with a sensation that the closure is being opened for the first time and improving abuse resistance (that is, inhibiting the tendency of the band to become loose) during shipment.

Securing the band 118 to disk 116 may also provide a resistance upon initial opening from the closure's fully applied state in circumstances in which engagement between closure threads 134 and container threads 152 does not provide such resistance. For example, during a retort process, a container and closure package, such as package 110, may be subjected to temperatures of (typically) 220° F. to 270° F. after filling and sealing of the container. The retort process may cause the plastic or other materials to relax such that the closure threads and container threads do not provide a suitable or sensible resistance (that is, a resistance that is noticeable to a user) to initial unscrewing. A loose closure or a closure having insufficient resistance to initial unscrewing may be interpreted as a deficient seal by a user or potential purchaser, even though the seal is intact. Engagement between curl 124 and gussets 138 may provide a sensible resistance against initial unscrewing of the container.

The term "securing" where employed to indicate a relationship between curl 124 and gussets 138, or between disk 116 and band 118, is used in the broadest way without regarding to the disengagement torque or to whether band 118 remains engaged with disk 116 throughout the opening process.

What is claimed is:

1. A composite closure for coupling with a container, comprising:

an insert disk including a curl formed at a periphery thereof; and a band including:

an annular skirt including threads formed on an interior surface thereof;

a retaining feature extending radially inwardly from the skirt;

a ring extending radially inwardly from an upper portion of the skirt over at least a portion of the disk; and plural fins extending inwardly from the skirt, the fins and the retaining feature forming a recess therebetween for receiving the disk curl, a contact surface of the fins being nonparallel, in longitudinal cross section, to a closure longitudinal axis;

the closure having a fully tightened position in which the ring contacts the disk, a loose position in which the ring is spaced apart from the disk, and an intermediate tightened position in which the ring is spaced apart from the disk and in which the contact surface urges against the curl, the intermediate tightened position being between the fully tightened position and the loose position, wherein the fins have a first, as-molded state prior to application of the closure onto the container and a second, fully applied state in which the fins deformably receive at least a portion of the curl upon application of the closure onto the container, whereby the fins engage the curl to removably secure the band to the disk.

2. The package of claim 1 wherein the closure threads engage the container threads in the fully tightened position upon initial application of the closure onto the container, and wherein said thread engagement diminishes upon later thermal treatment of the package.

3. The package of claim 2 wherein the engagement between the fins and the curl provides a sensible resistance upon initial rotation of the closure from its fully tightened position.

4. The package of claim 1 wherein a disengagement torque for disengaging the fins from the curl is less than an unsealing torque for breaking a seal between the disk and the container neck, whereby upon initial rotation of the closure from its fully tightened position the band disengages from the disk.

5. The package of claim 4 wherein the disengagement torque provides a sensible resistance upon initial rotation of the closure from its fully tightened position.

6. The package of claim 1 wherein a disengagement torque for disengaging the fins from the curl is more than an unsealing torque for breaking the seal between the disk and a container neck, whereby upon initial unscrewing of the closure the band and disk are unscrewed substantially together.

7. The package of claim 6 wherein the disengagement torque provides a sensible resistance upon initial rotation of the closure from its fully tightened position.

8. The package of claim 1 wherein the band further comprises a ring extending radially inwardly from an upper portion of the skirt over at least a portion of the disk.

9. The package of claim 1 wherein a portion of the fins are non-elastically deformed by the disk curl such that said curl is at least partially embedded in said fins.

10. The package of claim 9 wherein said fins are elastically deformed proximate the non-elastically deformed portions.

11. The package of claim 1 wherein the fins are gussets.

12. The package of claim 1 wherein the fins have a contact surface that is obliquely oriented relative to a longitudinal axis of the container.

13. The package of claim 1 wherein the fins are circumferentially spaced apart and oriented substantially radially.

* * * * *